US010752016B2

(12) United States Patent
Ogawa

(10) Patent No.: US 10,752,016 B2
(45) Date of Patent: Aug. 25, 2020

(54) PRINTING APPARATUS, PRINTING SYSTEM, PRINTING CONTROL METHOD AND COMPUTER-READABLE RECORDING MEDIUM

(71) Applicant: CASIO COMPUTER CO., LTD., Tokyo (JP)

(72) Inventor: Naoki Ogawa, Tachikawa (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 15/884,558

(22) Filed: Jan. 31, 2018

(65) Prior Publication Data

US 2018/0257396 A1 Sep. 13, 2018

(30) Foreign Application Priority Data

Mar. 10, 2017 (JP) ..... 2017-046229

(51) Int. Cl.

| | |
|---|---|
| ***B41J 2/35*** | (2006.01) |
| ***B41J 2/355*** | (2006.01) |
| ***B41J 2/325*** | (2006.01) |
| ***B41J 2/32*** | (2006.01) |
| *B41J 3/407* | (2006.01) |

(52) U.S. Cl.

CPC ..... *B41J 2/3558* (2013.01); *B41J 2/32* (2013.01); *B41J 2/325* (2013.01); *B41J 3/4075* (2013.01)

(58) Field of Classification Search

CPC ... B41J 2/3558; B41J 2/32; B41J 2/325; B41J 3/4075; B41J 2/36; B41J 2/362; B41J 2/365

See application file for complete search history.

(56) References Cited

U.S. PATENT DOCUMENTS

2004/0196353 A1 10/2004 Hosokawa et al.
2007/0030328 A1 2/2007 Tai et al.

FOREIGN PATENT DOCUMENTS

CN 1328060 C 7/2007
JP H04-320856 A 11/1992

(Continued)

OTHER PUBLICATIONS

The State Intellectual Property Office of People's Republic of China; Application No. 201810088106.X; Second Office Action dated Sep. 23, 2019.

(Continued)

*Primary Examiner* — Kristal Feggins
(74) *Attorney, Agent, or Firm* — Fitch, Even, Tabin & Flannery LLP

(57) ABSTRACT

A printing apparatus includes a thermal head and a processor. The thermal head prints an image on lines in a medium. The thermal head includes heat-generating elements to generate heat when a voltage is applied thereto in an application time, and the thermal head is controlled to sequentially on print each line. The processor is configured to: determine a specific line among lines based on printing data for printing lines, the specific line being a line estimated to have a possibility of sticking; and adjust the application time of an adjustment target line so as to be shorter than a reference application time, the adjustment target line having at least one line among lines, the at least one line being a line which is to be printed immediately before the specific line, the reference application time being set based on a temperature of the thermal head.

12 Claims, 15 Drawing Sheets

(56) References Cited

FOREIGN PATENT DOCUMENTS

| | | | |
|---|---|---|---|
| JP | 2002-347265 | A | 12/2002 |
| JP | 2004-181795 | A | 7/2004 |
| JP | 2005280054 | A | 10/2005 |
| JP | 2010-143199 | A | 7/2010 |
| JP | 2011-178122 | A | 9/2011 |
| JP | 2013-052539 | A | 3/2013 |
| JP | 2016-068289 | A | 5/2016 |

OTHER PUBLICATIONS

Indian Patent Office; Application No. 201814003508; Office Action dated Feb. 5, 2020.
JPO; Application No. 2017-046229; Notice of Reasons for Refusal dated Jun. 16, 2020.

FIG. 9A

D1

| ADJUSTMENT TARGET LINE |
| --- |
| 24th line |
| 25th line |
| 26th line |
| 27th line |
| 28th line |
| 29th line |

FIG. 9B

D2

| ADJUSTMENT TARGET LINE | APPLICATION TIME |
| --- | --- |
| 24th line | 90% |
| 25th line | |
| 26th line | |
| 27th line | |
| 28th line | |
| 29th line | |

FIG. 9C

D3

| ADJUSTMENT TARGET LINE | APPLICATION TIME |
| --- | --- |
| 24th line | 97% |
| 25th line | 94% |
| 26th line | 91% |
| 27th line | 88% |
| 28th line | 85% |
| 29th line | 82% |

FIG. 11

T1

| APPLICATION TIME TABLE | | |
|---|---|---|
| TEMPERATURE (°C) | MAIN APPLICATION TIME (μs) | HISTORY APPLICATION TIME (μs) |
| 0 | 449 | 300 |
| 1 | 443 | 296 |
| 2 | 438 | 292 |
| 3 | 432 | 288 |
| 4 | 426 | 284 |
| 5 | 421 | 280 |
| ⋮ | ⋮ | ⋮ |
| 28 | 287 | 191 |
| 29 | 281 | 188 |
| 30 | 274 | 183 |
| 31 | 269 | 179 |
| 32 | 265 | 177 |
| ⋮ | ⋮ | ⋮ |
| 60 | 190 | 126 |
| 61 | 188 | 125 |
| 62 | 186 | 124 |
| 63 | 184 | 123 |
| 64 | 183 | 122 |
| 65 | 182 | 121 |

PRINTING APPARATUS, PRINTING SYSTEM, PRINTING CONTROL METHOD AND COMPUTER-READABLE RECORDING MEDIUM

CROSS-REFERENCE TO RELATED APPLICATION

This application is based upon and claims the benefit of priority under 35 USC 119 of Japanese Patent Application No. 2017-046229, filed on Mar. 10, 2017, the entire disclosure of which, including the description, claims, drawings, and abstract, is incorporated herein by reference in its entirety.

BACKGROUND OF THE INVENTION

1. Field of the Invention

The disclosure relates to a printing apparatus, a printing system, a printing control method, and a computer-readable recording medium.

2. Description of the Related Art

In the related art, a printing apparatus configured to control application time to heat-generating elements provided to a thermal head and to transfer ink applied to an ink ribbon to a medium to be printed for printing has been known.

In the printing apparatus having adopted a thermal transfer method, a phenomenon referred to as 'sticking' that the ink ribbon is stuck to the thermal head when a rapid temperature change from high temperatures to low temperatures occurs in the thermal head may occur. When the sticking occurs, it is not possible to normally wind the ink ribbon. Thereby, a region in which the printing is not normally performed is partially generated, so that a printing quality is remarkably deteriorated.

JP-A-2013-052539 discloses a thermal printer configured to suppress sticking by chopper control. The chopper control is a technology of frequently switching application/non-application to the thermal head. By performing the chopper control, it is possible to suppress the rapid temperature change of the thermal head.

When a circuit for chopper control is added to the printing apparatus, the manufacturing cost of the product increases. In the meantime, implementation of the chopper control by software makes a control program complicated and causes the size to increase.

For this reason, a control that can suppress the sticking and is simpler than the chopper control is needed in the printing apparatus.

SUMMARY OF THE INVENTION

According to one aspect of the present invention, a printing apparatus includes a thermal head and a processor. The thermal head is configured to print an image by printing a plurality of lines on a medium. The thermal head includes a plurality of heat-generating elements configured to generate heat when a voltage is applied thereto in an application time, and the thermal head is controlled to sequentially print on each of the plurality of lines on the medium. The processor is configured to: determine a specific line among the plurality of lines based on printing data for printing the plurality of lines, the specific line being a line estimated to have a possibility of sticking; and adjust the application time of an adjustment target line so as to be shorter than a reference application time, the adjustment target line having at least one line among the plurality of lines, the at least one line being a line which is to be printed immediately before the specific line, the reference application time being set based on a temperature of the thermal head.

According to another aspect of the present invention, a printing apparatus includes a thermal head and a processor. The thermal head is configured to print an image being formed by a plurality of lines on a medium. The thermal head includes a plurality of heat-generating elements configured to generate heat when a voltage is applied thereto in an application time, and the thermal head is controlled to sequentially print on each of the plurality of lines on the medium. The processor is configured to adjust the application time of an adjustment target line so as to be shorter than a reference application time, the adjustment target line having at least one line among the plurality of lines, the at least one line being a line which is to be printed immediately before a specific line estimated to have a possibility of sticking, the reference application time being set based on a temperature of the thermal head.

According to another aspect of the present invention, a printing system includes a printing apparatus and a computer. The printing apparatus includes a thermal head which is configured to print an image by printing a plurality of lines on a medium, and a processor. The computer is provided separately from the printing apparatus. The thermal head includes a plurality of heat-generating elements configured to generate heat when a voltage is applied thereto in an application time, and the thermal head is controlled to sequentially print on each of the plurality of lines on the medium. The computer is configured to: determine a specific line among the plurality of lines based on printing data for printing each of the plurality of lines, the specific line being a line estimated to have a possibility of sticking, and output specific line data for specifying the specific line among the plurality of lines, to the printing apparatus. The processor is configured to: set at least one line among the plurality of lines as an adjustment target line based on the specific line data, the at least one line being a line immediately before the specific line, and adjust the application time of the adjustment target line so as to be shorter than a reference application time, the reference application time is set based on a temperature of the thermal head.

According to another aspect of the present invention, a printing system includes a printing apparatus and a computer. The printing apparatus includes a thermal head which is configured to print an image by printing a plurality of lines on a medium, and a processor. The computer is provided separately from the printing apparatus. The thermal head includes a plurality of heat-generating elements configured to generate heat when a voltage is applied thereto in an application time, and the thermal head is controlled to sequentially print each of the plurality of lines on the medium. The computer is configured to: determine a specific line among the plurality of lines based on printing data for printing each of the plurality of lines, the specific line being a line estimated to have a possibility of sticking, and generate adjustment data for setting two or more lines among the plurality of lines, as the adjustment target lines, two or more lines being immediately before the specific line, and output the adjustment data to the printing apparatus. The processor is configured to: set the adjustment target lines based on the adjustment data, and adjust the application time of each of the adjustment target lines so that a difference between the application time and a reference application time is larger as each line is closer to the specific line, the reference application time being set based on a temperature of the thermal head.

According to another aspect of the present invention, a printing control method is a method of a printing apparatus. The printing apparatus includes a thermal head which is configured to print an image by printing a plurality of lines on a medium. The thermal head includes a plurality of heat-generating elements configured to generate heat when a voltage is applied thereto in an application time, and the thermal head is controlled to sequentially print on each of the plurality of lines on the medium. The printing control method comprises: determining a specific line among the plurality of lines based on printing data for printing the plurality of lines, the specific line being a line estimated to have a possibility of sticking; and adjusting the application time of an adjustment target line so as to be shorter than a reference application time, the adjustment target line being at least one line among the plurality of lines, the at least one line being a line which is to be printed immediately before the specific line, the reference application time being set based on a temperature of the thermal head.

According to another aspect of the present invention, a computer-readable recording medium having a printing control program controls a printing apparatus recorded therein. The printing apparatus includes a thermal head which is configured to print an image by printing a plurality of lines on a medium. The thermal head includes a plurality of heat-generating elements configured to generate heat when a voltage is applied thereto in an application time, and the thermal head is controlled to sequentially print each of the plurality of lines on the medium. The printing control program is configured to allow a computer: to determine a specific line among the plurality of lines based on printing data for printing the plurality of lines, the specific line being a line estimated to have a possibility of sticking; and to adjust application time of an adjustment target line so as to be shorter than a reference application time, the adjustment target line being at least one line among the plurality of lines, the at least one line being a line which is to be printed immediately before the specific line, the reference application time being set based on a temperature of the thermal head.

BRIEF DESCRIPTION OF THE SEVERAL VIEWS OF THE DRAWING

FIGS. 9A, 9B and 9C exemplify adjustment data.

FIG. 11 exemplifies an application time table.

DETAILED DESCRIPTION OF THE INVENTION

A printing apparatus in accordance with illustrative embodiments of the disclosure will be described in detail with reference to the drawings.

First Illustrative Embodiment

Figure 1:
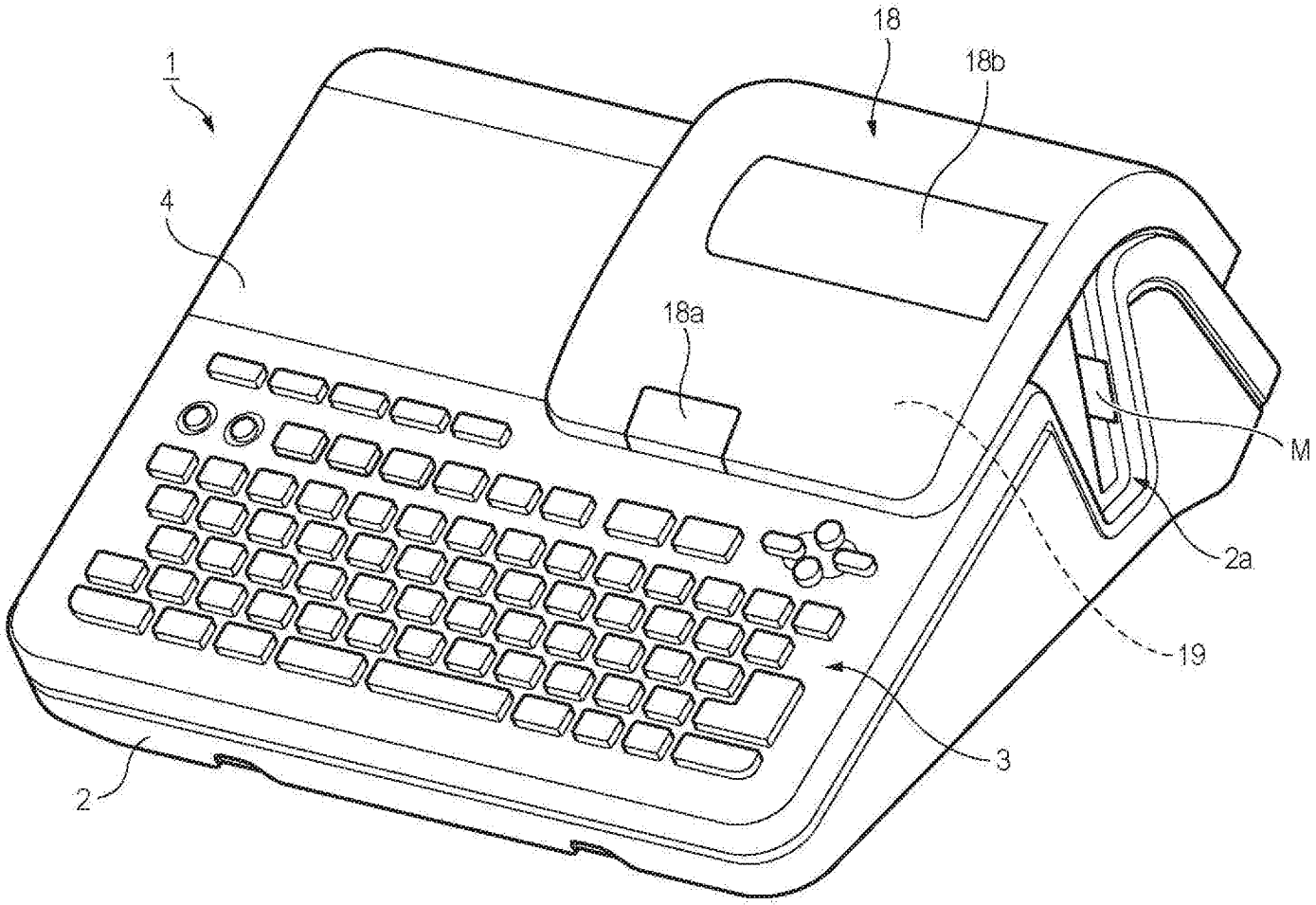
FIG. 1 is a perspective view of a printing apparatus 1.

FIG. 1 is a perspective view of a printing apparatus 1 in accordance with a first illustrative embodiment.

The printing apparatus 1 is a printing apparatus including a thermal head configured to perform printing on a medium to be printed. For example, the printing apparatus 1 is a label printer configured to perform printing on a long medium to be printed M in a single-path manner.

In the below, the label printer of a thermal transfer method using an ink ribbon will be exemplified. However, the printing method is not particularly limited. The printing method may be any method in which a sticking may occur. For example, the printing method may be a thermosensitive method using a heat-sensitive paper.

The medium to be printed M is a long tape member including a base material having an adhesive layer and a release paper releasably adhered to the base material so as to cover the adhesive layer. In the meantime, the medium to be printed M may be a tape member without release paper.

As shown in FIG. 1, the printing apparatus 1 includes an apparatus housing 2, an input unit 3, a display device 4, an opening and closing cover 18, and a cassette storage unit 19.

The input unit 3, the display device 4, and the opening and closing cover 18 are arranged on an upper surface of the apparatus housing 2.

Although not shown, the apparatus housing 2 is provided with a power supply cord connection terminal, an external device connection terminal, a storage medium insertion port, and the like.

The input unit 3 includes a variety of keys such as an input key, arrow keys, a conversion key, an enter key, and the like.

The display device 4 is a liquid crystal display panel, for example, and is configured to display letters corresponding to an input from the input unit 3, a selection menu for diverse setting, messages relating diverse processing, and the like. During the printing, a content (hereinafter, referred to as printing content) such as a letter, a figure and the like, which are instructed to be printed on the medium to be printed M, is displayed on the display device 4, and a progressing status of printing processing may be further displayed thereon.

In the meantime, the display device 4 may be provided with a touch panel unit. In this case, the display device 4 may be considered as a part of the input unit 3.

The opening and closing cover 18 is arranged to be openable and closable at an upper part of the cassette storage unit 19. The opening and closing cover 18 is opened when a button 18*a* is pushed.

The opening and closing cover 18 is provided with a window 18*b* so as to check whether a tape cassette 30 (refer to FIG. 2) is accommodated in the cassette storage unit 19 with naked eyes even at a state where the opening and closing cover 18 is closed.

A side surface of the apparatus housing 2 is formed with a discharge port 2*a*.

The medium to be printed M for which the printing has been performed in the printing apparatus 1 is discharged from the discharge port 2*a* to an outside of the apparatus.

Figure 2:
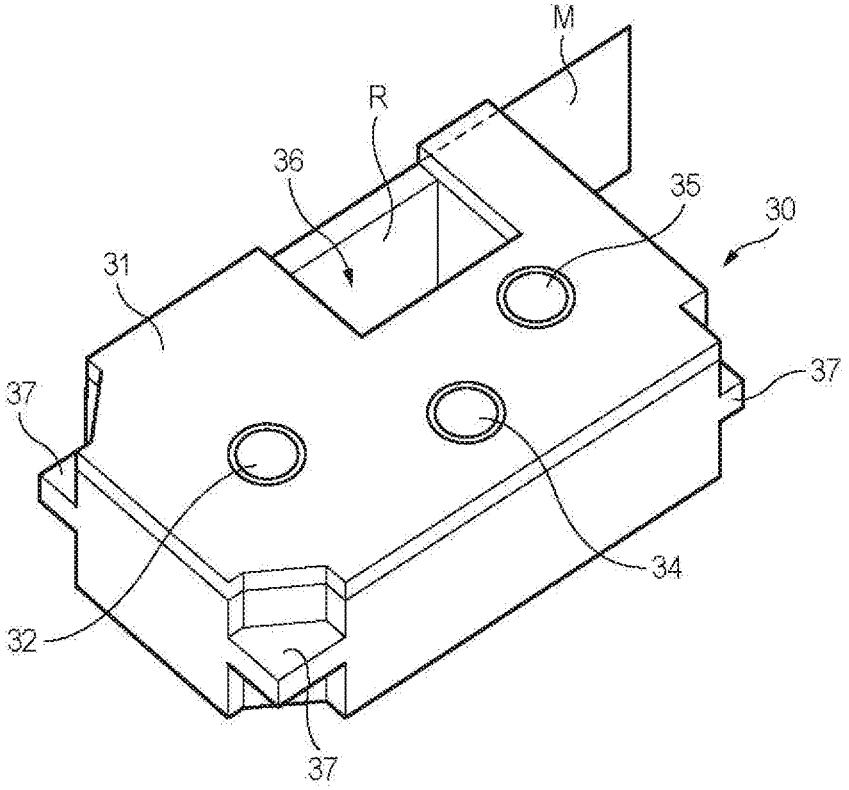
FIG. 2 is a perspective view of a tape cassette 30 that is to be accommodated in the printing apparatus 1.

FIG. 2 is a perspective view of a tape cassette 30 that is to be accommodated in the printing apparatus 1.

Figure 3:
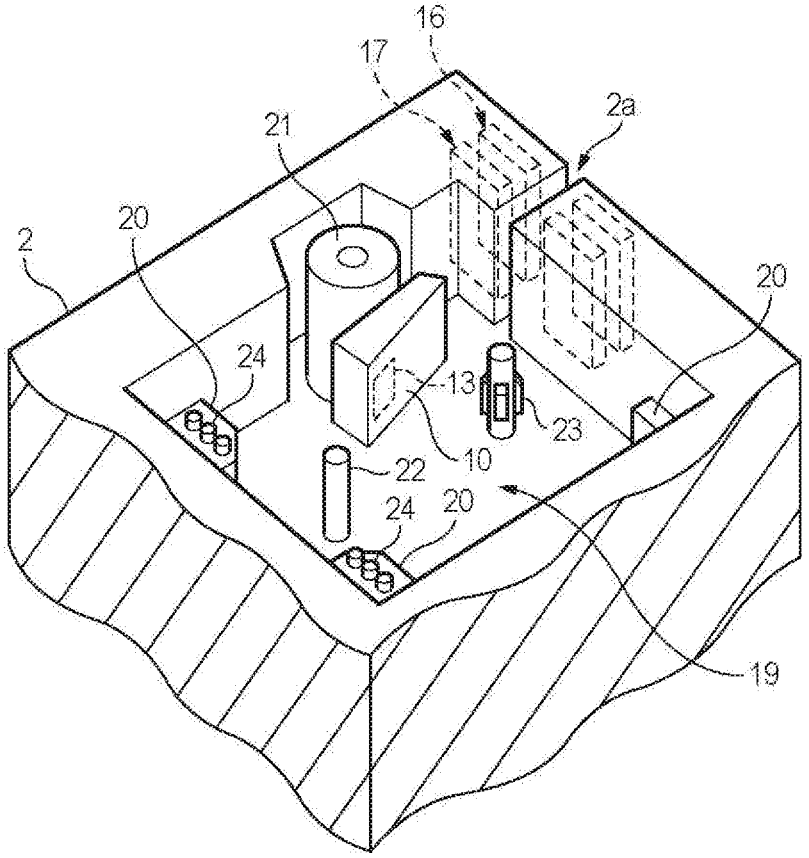
FIG. 3 is a perspective view of a cassette storage unit 19 of the printing apparatus 1.

FIG. 3 is a perspective view of the cassette storage unit 19 of the printing apparatus 1.

Figure 4:
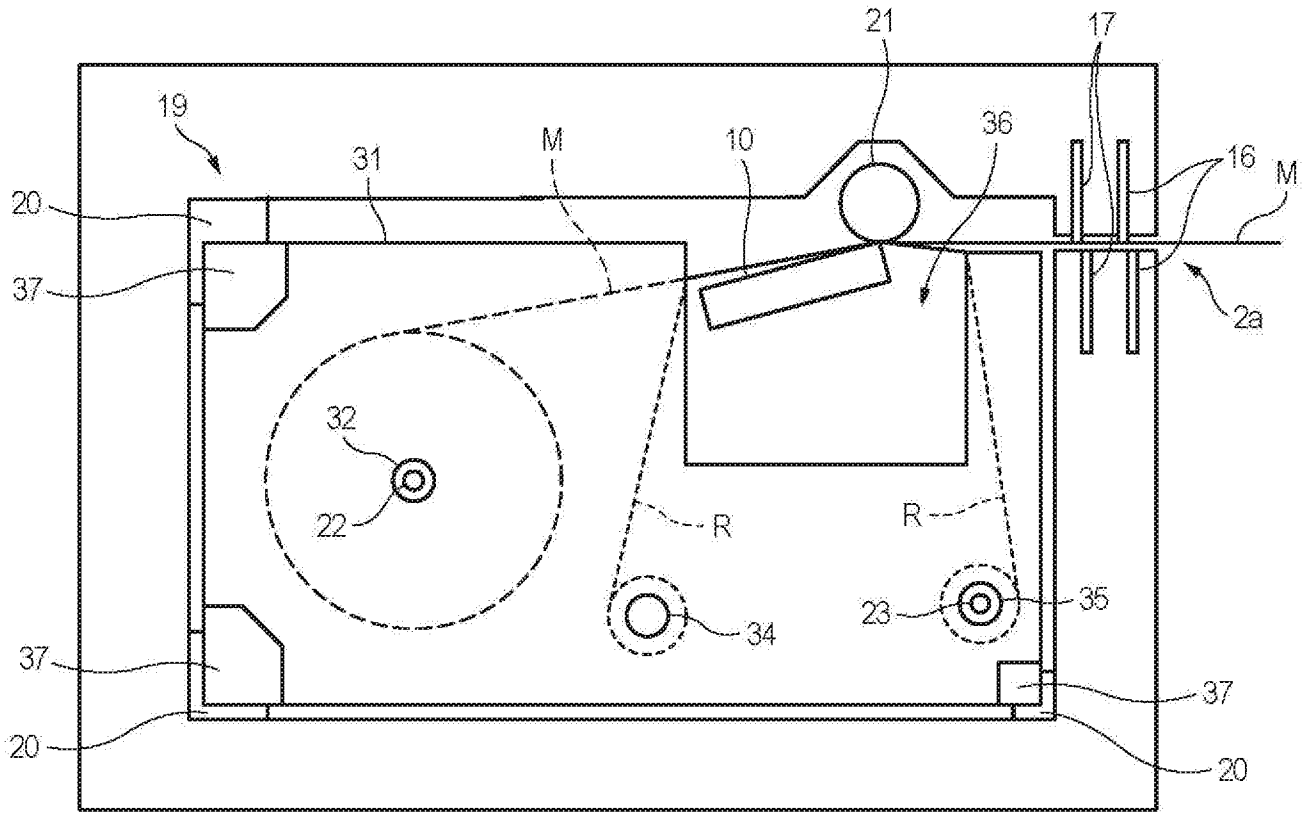
FIG. 4 is a sectional view of the printing apparatus 1.

FIG. 4 is a sectional view of the printing apparatus 1.

The tape cassette 30 shown in FIG. 2 is accommodated in the cassette storage unit 19 shown in FIG. 3 so as to be freely mounted and demounted.

FIG. 4 depicts a state where the tape cassette 30 is accommodated in the cassette storage unit 19.

As shown in FIG. 2, the tape cassette 30 has a cassette case 31 configured to accommodate therein the medium to be printed M and an ink ribbon R and formed with a thermal head insertion part 36 and engaging parts 37.

The cassette case 31 is provided with a tape core 32, an ink ribbon supply core 34, and an ink ribbon winding core 35.

The medium to be printed M is wound on the tape core 32 in the cassette case 31 in a roll shape.

The ink ribbon R for thermal transfer is wound on the ink ribbon supply core 34 within the cassette case 31 in a roll shape at a state where a tip end thereof is wound on the ink ribbon winding core 35.

As shown in FIG. 3, the cassette storage unit 19 of the apparatus housing 2 is provided with a plurality of cassette receiving parts 20 for supporting the tape cassette 30 at a predetermined position.

The cassette receiving part 20 is provided with a tape width detection switch 24 for detecting a width of a tape (medium to be printed M) to be accommodated in the tape cassette 30.

The tape width detection switch 24 is a detection unit configured to detect a width of the medium to be printed M based on a shape of the cassette.

The cassette storage unit 19 is further provided with a thermal head 10 having a plurality of heat-generating elements and configured to perform printing on the medium to be printed M, a platen roller 21, which is a conveyance unit configured to convey the medium to be printed M, a tape core engaging shaft 22, and an ink ribbon winding drive shaft 23.

In the thermal head 10, a thermistor 13 is embedded.

The thermistor 13 is a head temperature measuring unit configured to measure a temperature of the thermal head 10.

As shown in FIG. 4, at a state where the tape cassette 30 is accommodated in the cassette storage unit 19, the engaging parts 37 provided to the cassette case 31 are supported to the cassette receiving parts 20 provided to the cassette storage unit 19. Then, the thermal head 10 is inserted in the thermal head insertion part 36 formed in the cassette case 31.

The tape core engaging shaft 22 is engaged with the tape core 32 of the tape cassette 30. The ink ribbon winding drive shaft 23 is engaged with the ink ribbon winding core 35.

When a printing instruction is input to the printing apparatus 1, the medium to be printed M is supplied from the tape core 32 by rotation of the platen roller 21.

At this time, the ink ribbon winding drive shaft 23 is synchronously rotated with the platen roller 21, so that the ink ribbon R is supplied from the ink ribbon supply core 34 together with the medium to be printed M. Thereby, the medium to be printed M and the ink ribbon R are conveyed with being superimposed on each other.

When passing between the thermal head 10 and the platen roller 21, the ink ribbon R is heated by the thermal head 10, so that the ink is transferred to the medium to be printed M and the printing is thus performed. The used ink ribbon R of which the ink has been transferred to the medium to be printed M is wound to the ink ribbon winding core 35.

The used ink ribbon R having passed between the thermal head 10 and the platen roller 21 is wound to the ink ribbon winding core 35.

In the meantime, the printed medium to be printed M having passed between the thermal head 10 and the platen roller 21 is cut by a half-cut device 16 and a full-cut device 17 and is then discharged from the discharge port 2*a*.

Figure 5:
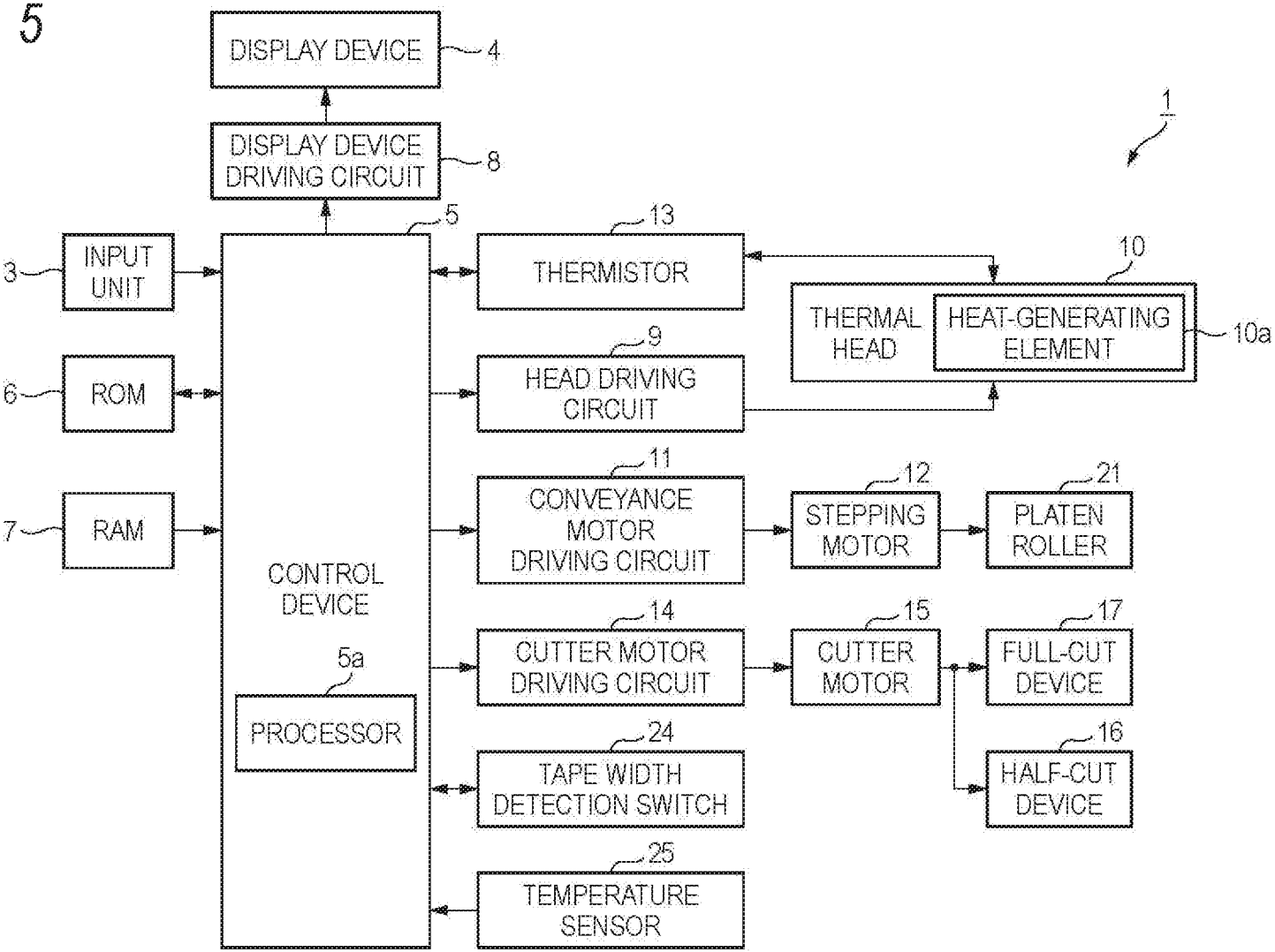
FIG. 5 is a block diagram depicting a hardware structure of the printing apparatus 1.

FIG. 5 is a block diagram depicting a hardware structure of the printing apparatus 1.

The printing apparatus 1 includes a control device 5, a ROM (Read Only Memory) 6, a RAM (Random Access Memory) 7, a display device driving circuit 8, a head driving circuit 9, a conveyance motor driving circuit 11, a stepping motor 12, a cutter motor driving circuit 14, a cutter motor 15, and a temperature sensor 25, in addition to the input unit 3, the display device 4, the thermal head 10, the thermistor 13, the half-cut device 16, the full-cut device 17, the platen roller 21, and the tape width detection switch 24.

In the meantime, at least the control device 5, the ROM 6 and the RAM 7 configure a computer of the printing apparatus 1.

The control device 5 includes a processor 5*a* such as a CPU (Central Processing Unit) and the like, for example. The control device 5 is configured to develop programs stored in the ROM 6 into the RAM 7 and to execute the same, thereby controlling operations of the respective units of the printing apparatus 1.

The control device 5 functions as an estimation unit configured to estimate a line having a relatively high possibility of occurrence of sticking, based on printing data.

In the meantime, the control device 5 may function as an estimation unit configured to estimate a line having a possibility that at least the sticking will occur at the line, based on printing data.

The control device 5 functions as a head control unit configured to control the thermal head 10 via the head driving circuit 9, and is configured to supply at least a strobe signal and printing data to the head driving circuit 9.

The control device 5 functions as a data generation unit configured to generate adjustment data for setting an adjustment target line for which time of an application time period is adjusted.

More specifically, the control device 5 is configured to generate adjustment data for setting a predetermined number of two or more lines, which are to be printed before a line for which it is estimated that the sticking will occur is printed, as adjustment target lines. Then, the control device 5 may supply a strobe signal, which is a control signal of which timing has been adjusted based on the adjustment data, to the head driving circuit 9.

The control device 5 functions as a conveyance control unit configured to control the platen roller 21.

Also, the control device 5 functions as a cut control unit configured to control a cut device.

In the ROM 6, a printing program for performing the printing on the medium to be printed M, and a variety of data (for example, fonts, an application time table, and the like) necessary to execute the printing program are stored.

The ROM 6 functions as a storage medium in which a program, which can be read by the control device 5, is stored.

The RAM 7 includes a printing data storage part in which data (hereinafter, referred to as 'printing data') indicative of a pattern of printing content is stored.

Also, the RAM 7 includes a display data storage part in which display data is stored.

The display device driving circuit 8 is configured to control the display device 4, based on the display data stored in the RAM 7.

The display device 4 may display the printing content in such an aspect that a user can recognize a progressing status of printing processing, under control of the display device driving circuit 8, for example.

The head driving circuit 9 is a head driving unit configured to drive the thermal head 10, based on the strobe signal, which is a control signal to be supplied from the control device 5, and the printing data.

More specifically, for a time period in which the strobe signal (control signal) is ON (hereinafter, referred to as 'application time period'), current to be supplied to the plurality of heat-generating elements 10*a* is energized or de-energized based on the printing data.

The thermal head 10 is a printing head having the plurality of heat-generating elements 10*a* aligned in a main scanning direction.

The head driving circuit 9 is configured to enable the heat-generating elements 10*a* to generate heat and to heat the ink ribbon R by selectively energizing the current to be supplied to the heat-generating elements 10*a*, in correspondence to the printing data, for the application time period of the strobe signal supplied from the control device 5. Thereby, the thermal head 10 prints a plurality of lines line by line on the medium to be printed M by the thermal transfer.

The conveyance motor driving circuit 11 is configured to drive the stepping motor 12.

The stepping motor 12 is configured to rotate the platen roller 21.

The platen roller 21 is a conveyance unit configured to rotate by power from the stepping motor 12 and to convey the medium to be printed M in a longitudinal direction (sub-scanning direction) of the medium to be printed M.

The cutter motor driving circuit 14 is configured to drive the cutter motor 15.

The half-cut device 16 and the full-cut device 17 are configured to operate by power from the cutter motor 15, thereby half-cutting or full-cutting the medium to be printed M.

The full cut is an operation of cutting the base material of the medium to be printed M together with the release paper along the width direction, and the half cut is an operation of cutting only the base material along the width direction.

The temperature sensor 25 is an environment temperature measuring device configured to measure a temperature around the printing apparatus 1, as an environment temperature.

Figure 6:
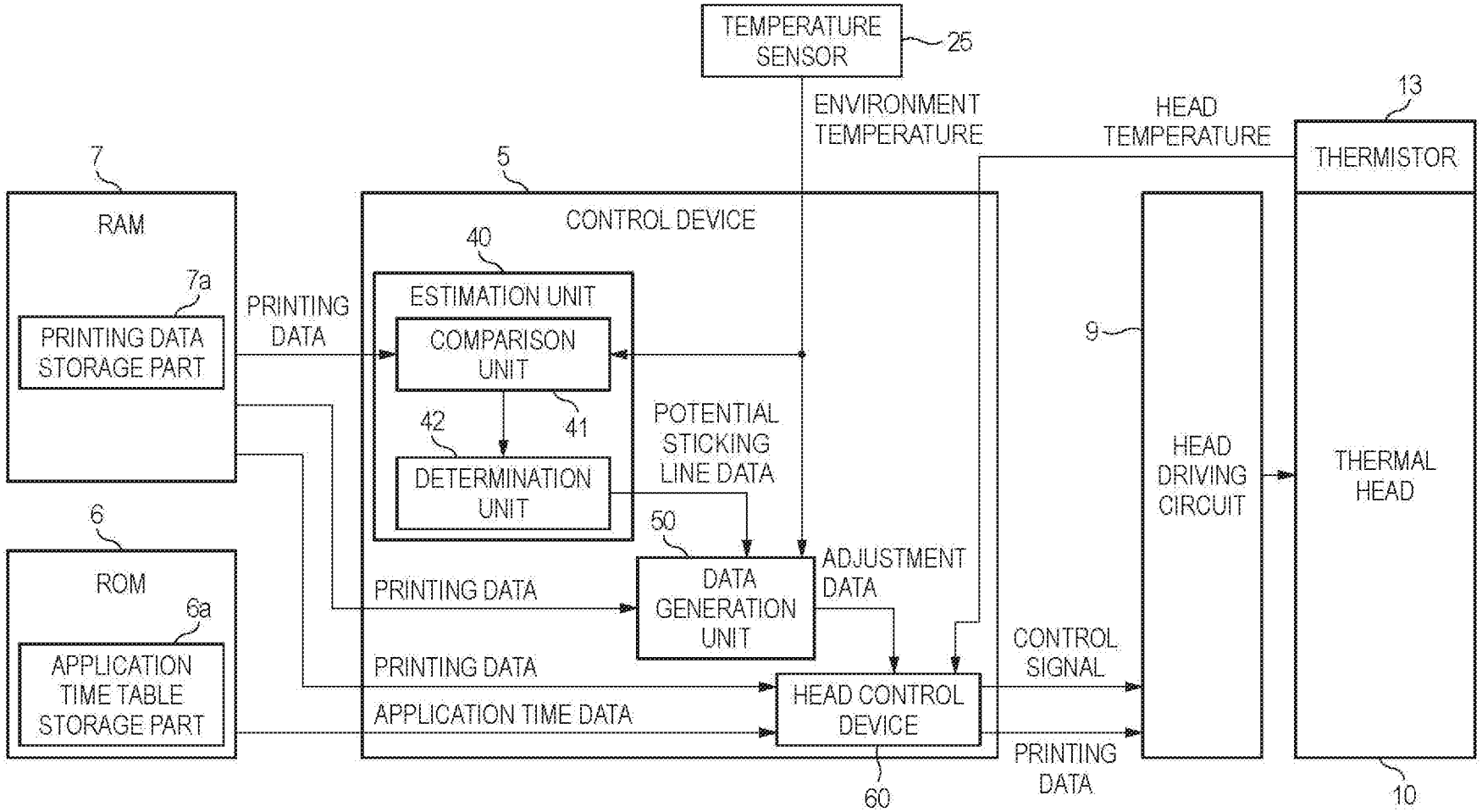
FIG. 6 is a block diagram depicting a functional structure of the printing apparatus 1.

FIG. 6 is a block diagram depicting a functional structure of the printing apparatus 1.

FIG. 6 mainly depicts a functional structure of the control device 5 included in the printing apparatus 1.

The control device 5 includes an estimation unit 40, a data generation unit 50, and a head control device 60.

The estimation unit 40 is configured to estimate, as a specific line (a sticking occurrence estimation line), a line having a relatively high possibility of occurrence of sticking, based on printing data including a plurality of line data corresponding to a plurality of lines to be printed and provided so as to print on the plurality of lines by the thermal head 10.

The estimation unit 40 is configured to estimate the specific line by specifying a line having a possibility that a temperature of the thermal head 10 will rapidly decrease at the line, based on the printing data.

In the meantime, the printing data that is to be used by the estimation unit 40 is read out from a printing data storage part 7*a* of the RAMI.

More specifically, the estimation unit 40 includes a comparison unit 41, and a determination unit 42.

The comparison unit 41 is configured to compare two line data, which corresponds to two lines to be printed with being adjacent to each other, of the plurality of line data included in the printing data.

The determination unit 42 is configured to determine a line having a relatively high possibility of occurrence of sticking, based on a comparison result of the comparison unit 41.

That is, the estimation unit 40 is configured to estimate the specific line, based on the comparison result of the two line data, which corresponds to two lines to be printed with being adjacent to each other. The reason is that it is possible to expect a rapid temperature change, which will occur between two lines to be printed with being adjacent to each other, by comparing the two line data corresponding to two lines to be printed with being adjacent to each other.

The comparison unit 41 may be configured to compare a number of printing dots, which are specified based on one of two line data corresponding to two lines to be printed with being adjacent to each other and are set to be printed on the medium to be printed M by enabling the heat-generating elements 10*a* of the thermal head 10 to generate heat, and a number of printing dots, which are specified based on the other of two line data corresponding to two lines to be printed with being adjacent to each other, for example. The reason is that it is possible to expect temperature lowering of the thermal head 10 by comparing the numbers of printing dots.

The comparison unit 41 may also be configured to compare a number of printing dot groups, which are printing dots specified based on one of two line data corresponding to two lines to be printed with being adjacent to each other and continuously aligned by a predetermined number, and a number of printing dot groups, which are specified based on the other of two line data corresponding to two lines to be printed with being adjacent to each other, for example. When a plurality of printing dots is grouped, an influence on the temperature of the thermal head 10 may be increased, as compared to printing dots that are apart from each other. For this reason, it is possible to expect the temperature lowering of the thermal head 10 with higher precision by comparing the numbers of printing dot groups, each of which is a set of the plurality of printing dots.

The determination unit 42 may set a threshold value for a ratio of the numbers of printing dots or the numbers of printing dot groups or may set a threshold value for a decrease number of the number of printing dots or the number of printing dot groups, for example.

The determination unit 42 may determine that there is a relatively high possibility of occurrence of sticking, when the ratio or decrease number is equal to or greater than the threshold value.

In the meantime, the threshold value may be a preset value or may be a value that is set based on the environment temperature measured by the temperature sensor 25.

The lower the environment temperature, the sticking is generally more likely to occur. Therefore, when setting the threshold value based on the environment temperature, it is preferable to reduce the threshold value as the environment temperature is lower. Thereby, it is possible to further suppress the sticking.

The threshold value may also be set based on a width of the medium to be printed M detected by the tape width detection switch 24.

The estimation unit 40 is configured to output data (hereinafter, referred to as 'specific line data) for specifying the estimated specific line to the data generation unit 50.

The data generation unit 50 is configured to generate adjustment data for setting an adjustment target line for which time of the application time period is adjusted.

The data generation unit 50 is configured to specify the specific line based on the specific line data input from the estimation unit 40 and to generate adjustment data for setting an adjustment target line.

In the meantime, the adjustment target line is a line for which the time of the application time period is adjusted so as to suppress the rapid temperature lowering of the thermal head 10 at the specific line.

Herein, a temporal length of the application time period is referred to as 'application time'.

The data generation unit 50 is configured to set, as the adjustment target line, at least one line that is to be printed before (for example, immediately before) at least the specific line is printed.

The data generation unit 50 is configured to set, as the adjustment target lines, a plurality of lines continuing by a predetermined number, which are to be printed earlier than the specific line, and including a sticking-immediately preceding line, which is to be printed immediately before the specific line.

The data generation unit 50 may also be configured to set the number of adjustment target lines, based on the printing data.

It is expected that when the lines having a large number of printing dots or number of printing dot groups continue before (upstream) the specific line, the temperature of the thermal head 10 will increase at the sticking-immediately preceding line.

For this reason, the data generation unit 50 may be configured to count how many lines having the number of printing dots or number of printing dot groups equal to or greater than the threshold value continue before the specific line, and to set the number of adjustment target lines based on the number of lines to continue, for example.

The data generation unit 50 may also be configured to set the number of adjustment target lines based on the environment temperature measured by the temperature sensor 25.

In order that the temperature of the thermal head 10 is not to excessively increase at the sticking-immediately preceding line, it is preferable to increase the number of adjustment target lines as the environment temperature becomes lower.

The data generation unit 50 may also be configured to set the number of adjustment target lines based on both the environment temperature and the printing data.

The data generation unit 50 is configured to output the adjustment data to the head control device 60.

In the meantime, the adjustment data may include not only target information for designating lines, which are to be the adjustment target lines, of the plurality of lines and setting the designated lines as the adjustment target lines but also adjustment information for setting an adjustment amount of the application time for each adjustment target line.

The adjustment information may be a ratio (%) of application time after adjustment to application time becoming a reference (hereinafter, referred to as 'reference application time') or may be time (for example, μsec) that is to be subtracted from the reference application time so as to calculate the application time after adjustment.

In the meantime, the reference application time is application time that is to be set based on the temperature of the thermal head 10 and is to be set as time suitable for performing the printing by the thermal head 10, for example, and is calculated for each line. The adjustment data includes the adjustment information, so that it is possible to adjust the application time, in correspondence to the situations (the environment and the printing data).

The adjustment data may include the adjustment information, which is common to all the adjustment target lines, or may include the adjustment information for each adjustment target line.

When the adjustment data includes the adjustment information for each adjustment target line, it is preferable to generate the adjustment information so that an adjustment amount of the application time stepwise increases toward the specific line, i.e., the application time after adjustment stepwise decreases.

Thereby, the adjustment amount is set so that a difference between the application time and the reference application time increases toward a line for which it is estimated that the sticking will occur. As a result, it is possible to minimize the lowering of a printing density, which is caused when the application time is adjusted.

The head control device 60 is configured to generate the strobe signal, which is a control signal in which the application time corresponding to at least the sticking-immediately preceding line is adjusted to be shorter than the time (reference application time) set based on the temperature of the thermal head 10.

Specifically, the head control device 60 is configured to generate the strobe signal in which the application time corresponding to the adjustment target line is adjusted to be shorter than the reference application time, based on the adjustment data generated at the data generation unit 50.

More specifically, the head control device 60 is configured to calculate the reference application time based on the application time data read out from an application table storage part **6*a* of the ROM 6 and the head temperature measured by the thermistor 13**.

The head control device 60 is further configured to calculate the application time after adjustment, based on the calculated reference application time and the adjustment data.

Then, the head control device 60 is configured to output the printing data (line data) and the strobe signal (control signal) corresponding to the application time after adjustment to the head driving circuit 9.

The control device 5 configured as described above adjusts the application time of the plurality of heat-generating elements at each of at least one adjustment target line, which is to be printed before a line, for which it is estimated based on the printing data including the plurality of line data for printing each of the plurality of lines that the sticking will occur, of the plurality of lines is printed, to time shorter than the reference application time, which is set for the adjustment target line based on the temperature of the thermal head 10.

Figure 7:
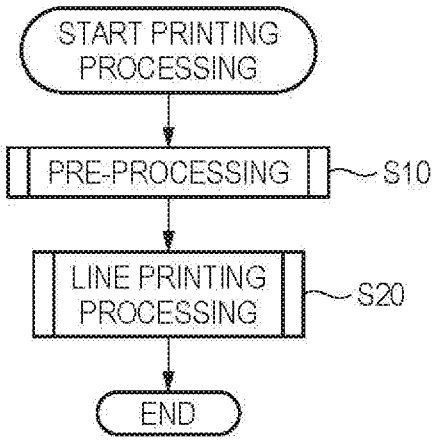
FIG. 7 is a flowchart of printing processing.

FIG. 7 is a flowchart of printing processing.

Figure 8:
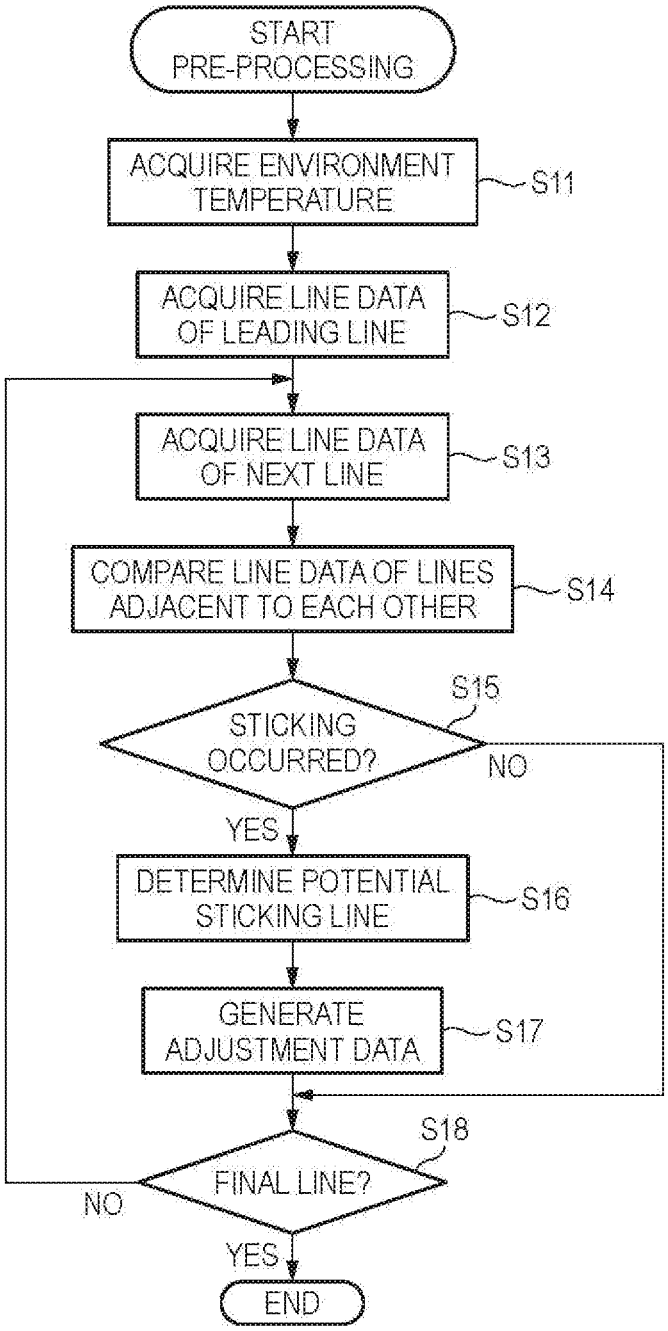
FIG. 8 is a flowchart of pre-processing.

FIG. 8 is a flowchart of pre-processing.

FIGS. 9A, 9B and 9C exemplify the adjustment data.

Figure 10:
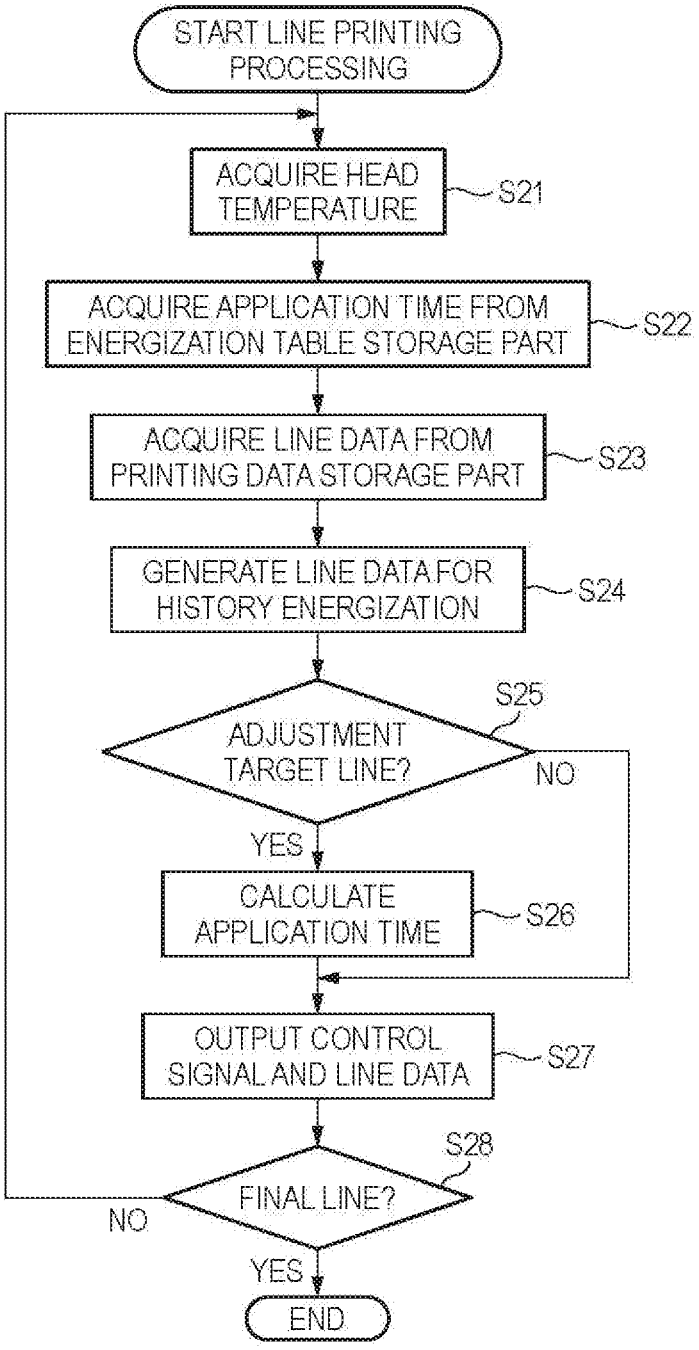
FIG. 10 is a flowchart of line printing processing.

FIG. 10 is a flowchart of line printing processing.

FIG. 11 exemplifies an application time table.

Figure 12:
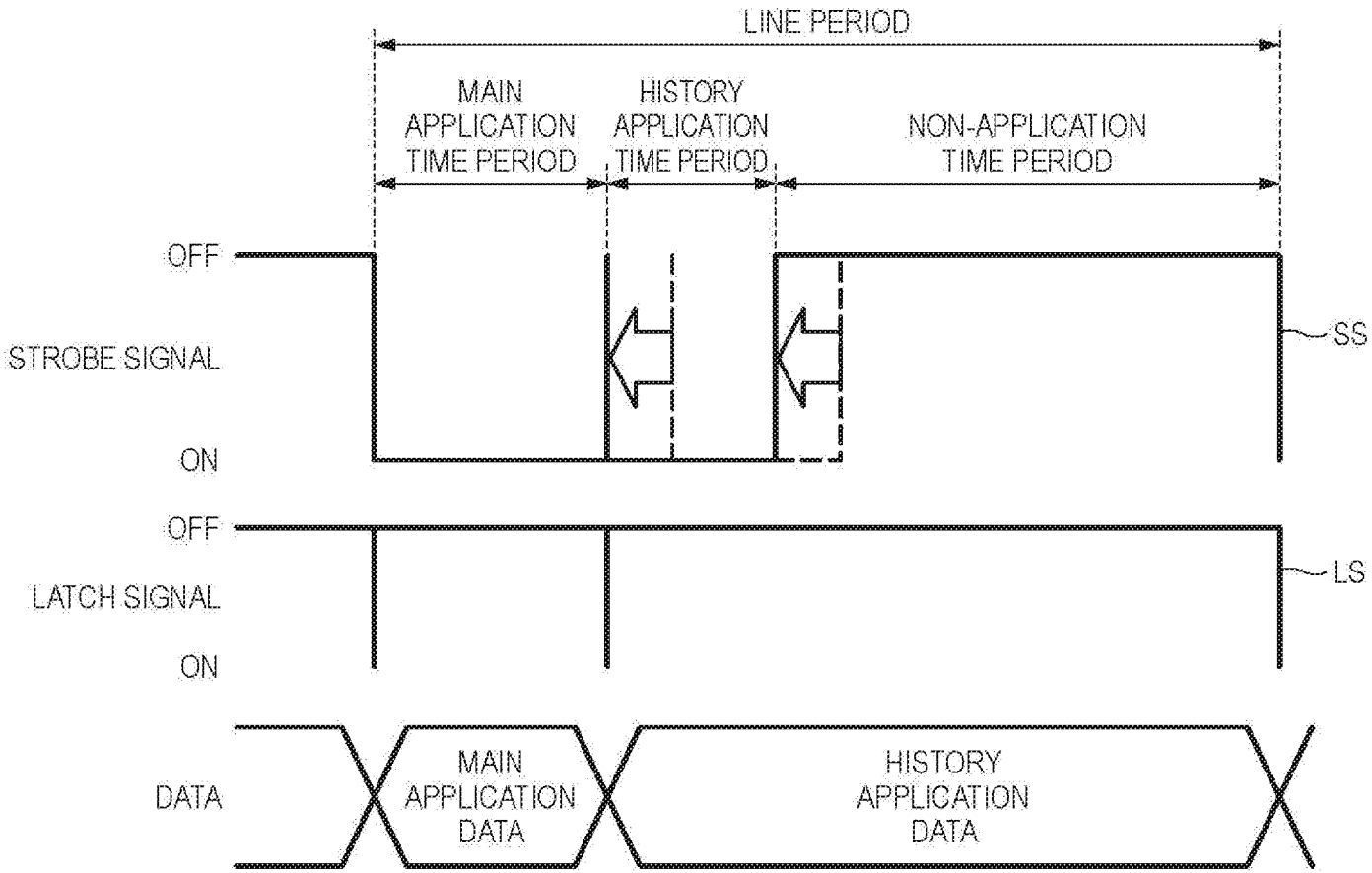
FIG. 12 illustrates a control signal.

FIG. 12 illustrates the control signal.

Figure 13:
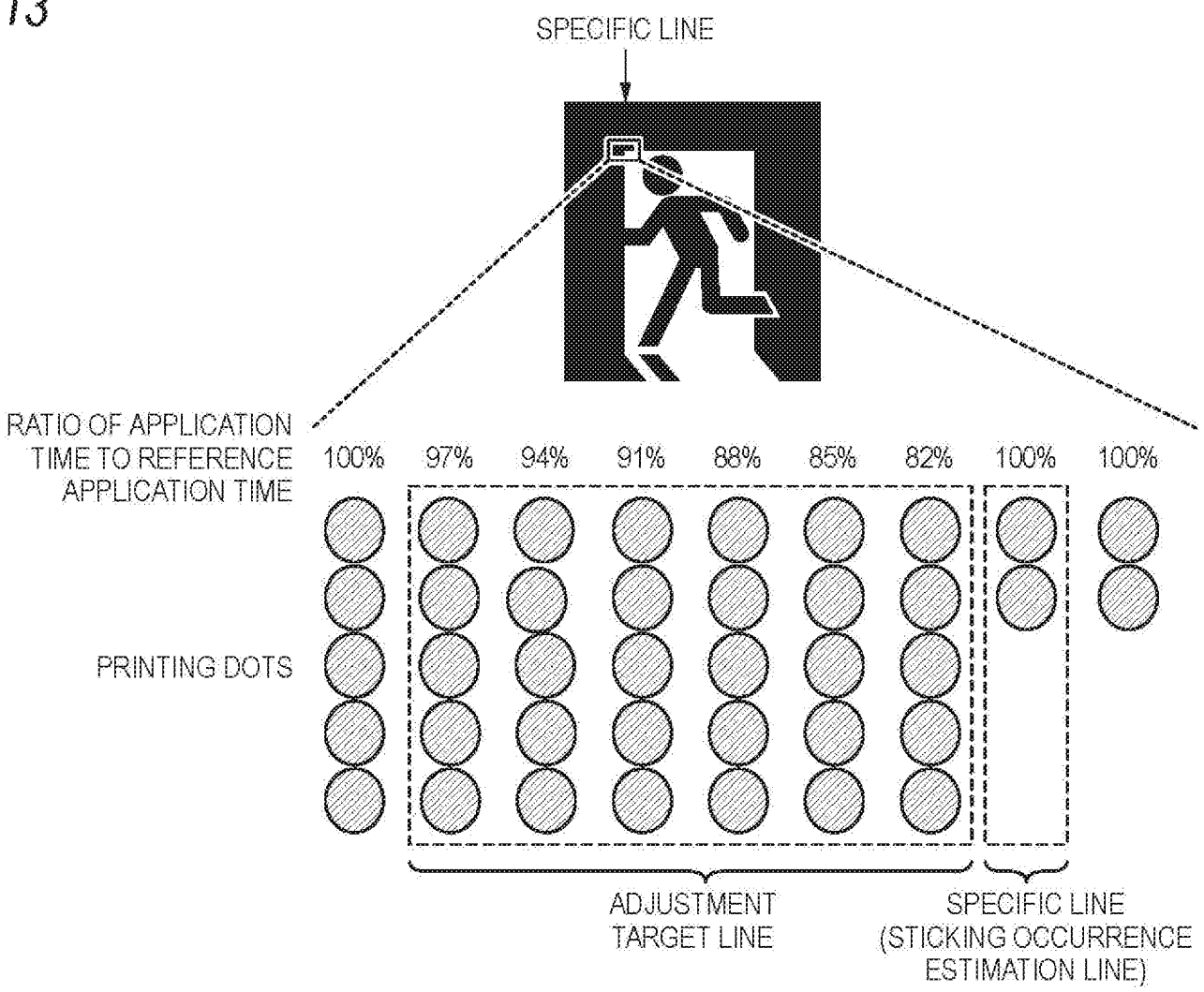
FIG. 13 depicts an example of time adjustment of an application time.

FIG. 13 depicts an example of time adjustment of the application time period.

Figure 14:
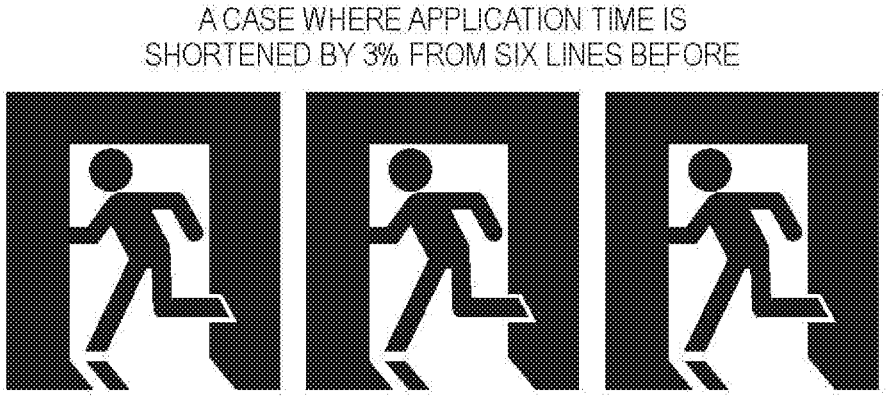
FIG. 14 depicts a printing example where the application time is shortened by 3% from a sixth line before a specific line.

FIG. 14 depicts a printing example where the application time has been shortened by 3% from a sixth line before the specific line.

Figure 15:
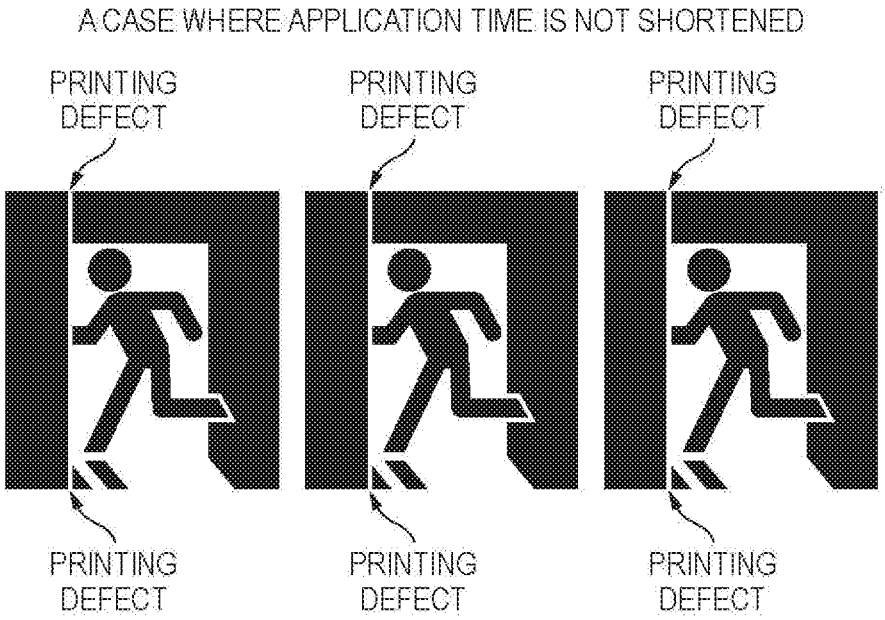
FIG. 15 depicts a printing example where the application time is not shortened.

FIG. 15 depicts a printing example where the application time has not been shortened.

In the below, printing processing that is to be executed by the printing apparatus 1 is described in detail with reference to FIGS. 7 to 15.

When the printing data is input and the printing processing shown in FIG. 7 starts, the printing apparatus 1 first executes pre-processing based on the printing data (step S10).

Then, the printing apparatus executes line printing processing, based on each line data included in the printing data (step S20).

In the pre-processing, as shown in FIG. 8, the printing apparatus 1 first acquires data of the environment temperature around the printing apparatus 1 (step S11). Herein, the control device 5 acquires data of the environment temperature that is output from the temperature sensor 25.

Then, the printing apparatus 1 acquires line data of a leading line of the printing data and line data of a next line thereof (step S12, step S13).

Herein, the control device 5 reads out the line data of the leading line from the RAM 7 (step S12) and then reads out the line data of the next line (step S13).

Thereafter, the printing apparatus 1 compares two line data corresponding to two lines that are to be printed with being adjacent to each other (step S14).

Herein, the control device 5 (comparison unit 41) compares the line data of the next line acquired in step S13 and line data (hereinafter, referred to as 'pre-line data'. For example, the line data of the leading line acquired in step S12) of a line spaced by one line before the next line.

In step S14, specifically, for example, the printing apparatus counts the numbers of data "0xff", which indicates the printing dots continuing by 8 dots and included in each of the line data of the pre-line and the line data of the next line, and calculates a ratio thereof (the number of 0xff of the leading line/the number of 0xff of the next line).

Based on the comparison result, the printing apparatus 1 determines whether the next line is the specific line (step S15).

Herein, the control device 5 (determination unit 42) determines whether a possibility of occurrence of sticking at the next line is relatively high, based on the comparison result of the line data of the pre-line and the line data of the next line.

Specifically, for example, when the ratio (the number of 0xff of the pre-line/the number of 0xff of the next line) calculated in step S14 is greater than 1.5, it is determined that a possibility of occurrence of sticking is relatively high, and when the ratio is equal to or smaller than 1.5, it is determined that the possibility of occurrence of sticking is relatively low.

When it is determined that the possibility of occurrence of sticking is relatively low, processing of step S16 and step S17 is skipped.

On the other hand, when it is determined that the possibility of occurrence of sticking is relatively high, the printing apparatus 1 determines the specific line (step S16).

Herein, the control device 5 (determination unit 42) determines the next line as the specific line.

When the specific line is determined, the printing apparatus 1 generates the adjustment data (step S17).

Herein, the control device 5 (data generation unit 50) generates the adjustment data for setting the adjustment target lines based on the specific line determined in step S16.

Specifically, for example, the printing apparatus sets the number of adjustment target lines, based on the data of the environment temperature acquired in step S11.

Also, the printing apparatus generates the adjustment data for setting, as the adjustment target lines, lines corresponding to the number of adjustment target lines existing before the specific line determined in step S16.

Thereafter, the printing apparatus 1 determines whether the next line of which the line data has been acquired in step S13 is a final line, based on the printing data (step S18).

When it is determined that the next line is a final line, the printing apparatus ends the pre-processing.

On the other hand, when it is determined that the next line is not a final line, the printing apparatus repeats the processing of steps S13 to S18 until it is determined in step S18 that the next line is a final line.

By the above processing, for example, adjustment data D1 shown in FIG. 9A, adjustment data D2 shown in FIG. 9B and adjustment data D3 shown in FIG. 9C are generated.

In the meantime, all of the adjustment data D1 to D3 shown in FIGS. 9A, 9B and 9C are examples of data that is generated when a thirtieth line is determined as the specific line and the number of adjustment target lines is 6 lines.

The adjustment data D1 is the adjustment data including only the target information for setting the adjustment target lines.

The adjustment data D2 and D3 is the adjustment data including the target information for setting the adjustment target lines and the adjustment information for setting the adjustment amount of the application time period.

The adjustment data D2 is the adjustment data including the adjustment information common to all of the adjustment target lines.

The adjustment data D3 is the adjustment data including the adjustment information for each adjustment target line, and is data that is generated when the application time is shortened by 3% every one adjustment target line.

When the pre-processing shown in FIG. 8 is over, the printing apparatus 1 starts line printing processing shown in FIG. 10.

In the line printing processing, the printing apparatus 1 first acquires the data of the head temperature of the thermal head 10 (step S21).

Herein, the control device 5 (head control device 60) acquires data of the head temperature, which is output from the thermistor 13.

Then, the printing apparatus 1 acquires the application time from the application time table storage part 6*a* of the ROM 6 (step S22).

Herein, the control device 5 (head control device 60) refers to an application time table stored in the application time table storage part 6*a* and acquires the application time corresponding to the head temperature.

Specifically, the printing apparatus executes retrieval processing for an application time table T1 shown in FIG. 11, for example, by using the head temperature acquired in step S21 as a key, and acquires main application time and history application time from a record corresponding to the head temperature.

When the application time is acquired, the printing apparatus 1 acquires line data (hereinafter, referred to as 'line data for main application') from the printing data storage part 7*a* of the RAM 7 (step S23), and generates line data for history application (step S24).

Herein, the control device 5 (head control device 60) generates the line data for history application, based on the line data for main application.

In the meantime, the line data for main application is line data indicative of a printing pattern to be formed at a line, which is a printing target for the application time period. The history application data is line data, which is to be generated based on line data of a preceding line (for example, a line spaced by one line before a line to be printed) that is to be printed temporally earlier than a line to be printed, and is data for controlling so that the heat-generating elements 10*a* of the thermal head 10 are at appropriate temperature when printing a printing target line after printing the preceding line.

Thereafter, the printing apparatus 1 determines whether the line of which the line data has been acquired in step S23 is the adjustment target line (step S25).

Herein, the control device 5 (head control device 60) performs the determination based on the adjustment data.

Specifically, the control device 5 determines whether the line is the adjustment target line by referring to the target information of the adjustment data.

When it is determined that the line is not the adjustment target line, processing of step S26 is skipped.

On the other hand, when it is determined that the line is the adjustment target line, the printing apparatus 1 calculates the application time (step S26).

Herein, the control device 5 (head control device 60) calculates application time shorter than the application time acquired in step S22.

Specifically, when the adjustment data D2 shown in FIG. 9B is generated in the pre-processing, the control device 5 calculates the main application time after adjustment, based on the main application time acquired in step S22 and the adjustment information (the application time 90%).

Then, the printing apparatus 1 outputs the control signal and the line data to the head driving circuit 9 (step S27).

Herein, the control device 5 (head control device 60) outputs the strobe signal, which is the control signal, the line data for main application acquired in step S23, and the line data for history application generated in step S24 to the head driving circuit 9.

Specifically, when a determination result of step S25 is NO, the control device 5 generates a strobe signal corresponding to the main application time and history application time acquired in step S22, and outputs the same to the head driving circuit 9.

On the other hand, when a determination result of step S25 is YES, the control device 5 generates a strobe signal corresponding to the main application time calculated in step S26 and history application time acquired in step S22, and outputs the same to the head driving circuit 9.

Thereby, as shown in FIG. 12, a strobe signal SS of which the application time is shortened and the non-application time is extended is output to the head driving circuit 9.

In the meantime, a timing of a latch signal LS is also changed, in conformity to the strobe signal SS.

Finally, the printing apparatus 1 determines whether the line of which the line data has been acquired in step S23 is a final line (step S28). When it is determined that the line is a final line, the printing apparatus ends the line printing processing. On the other hand, when it is determined that the line is not a final line, the printing apparatus repeats the processing of steps S21 to S28 until it is determined in step S28 that the line is a final line.

By the above processing, as shown in FIG. 13, at the adjustment target lines before the specific line, the heat-generating elements 10*a* are heated for the application time that has been shortened, as compared to at least the reference application time calculated based on the temperature of the thermal head 10.

Thereby, the increase in temperature of the thermal head 10 is suppressed just before the specific line, so that it is possible to suppress the rapid temperature decrease at the specific line.

Therefore, according to the printing apparatus 1, it is possible to suppress the occurrence of sticking by the above-described simple control. Also, as exemplified in FIG. 13, the application time is stepwise shortened, so that it is possible to suppress the sticking without deteriorating the printing quality.

FIG. 14 depicts a printing example that has been made when the control of adjusting the application time has been performed.

FIG. 15 depicts a printing example that has been made when the control of adjusting the application time has not been performed.

In the examples, the same content is continuously printed three times.

As shown in FIG. 15, when the application time has not been adjusted, the sticking occurred, so that the printing defect occurred. In contrast, when the application time has been adjusted, the occurrence of sticking was suppressed, so that the printing defect as shown in FIG. 15 did not occur, as shown in FIG. 14.

Second Illustrative Embodiment

Figure 16:
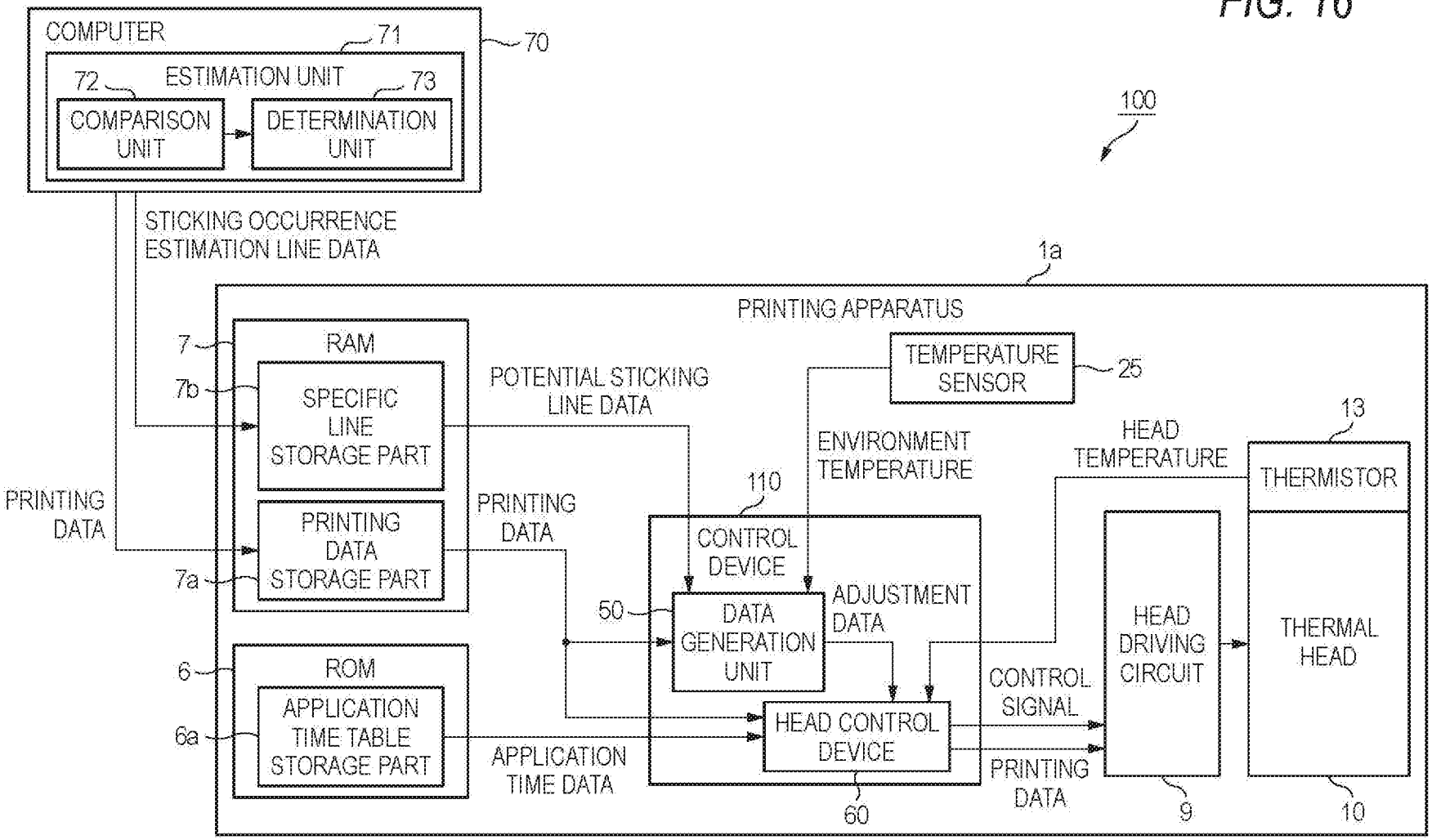
FIG. 16 exemplifies a hardware structure of a printing system 100.

FIG. 16 exemplifies a hardware structure of a printing system 100 in accordance with a second illustrative embodiment.

The printing system 100 includes a computer 70, and a printing apparatus 1*a*. The computer 70 is provided separately from the printing apparatus 1*a*, and can exchange information with the printing apparatus 1*a*. For example, the computer 70 is a standard computer, and includes a processor, a memory, a storage and the like.

The printing system 100 is different from the printing apparatus 1, in that some processing of the printing apparatus 1 in accordance with the first illustrative embodiment is executed by the computer 70.

The computer 70 has an estimation unit 71 configured to function similarly to the estimation unit 40 of the printing apparatus 1 as the processor executes a program.

The estimation unit 71 has a comparison unit 72 configured to function similarly to the comparison unit 41 of the printing apparatus 1, and a determination unit 73 configured to function similarly to the determination unit 42.

That is, the computer 70 has a structure of estimating the specific line based on the printing data and outputting the specific line data to the printing apparatus 1*a*.

The specific line data output from the computer 70 to the printing apparatus 1*a* is stored in a specific line storage part 7*b*.

The printing apparatus 1*a* is different from the printing apparatus 1, in that it has a control device 110, instead of the control device 5.

The control device 110 has the data generation unit 50 and the head control device 60 but does not have the estimation unit 40.

For this reason, the data generation unit 50 of the printing apparatus 1*a* is configured to read out the specific line data, which is output from the computer 70 and is stored in the specific line storage part 7*b*, and to generate the adjustment data.

Also in the printing system 100 of the second illustrative embodiment, it is possible to suppress the occurrence of sticking by the simple control, like the printing apparatus 1.

Third Illustrative Embodiment

Figure 17:
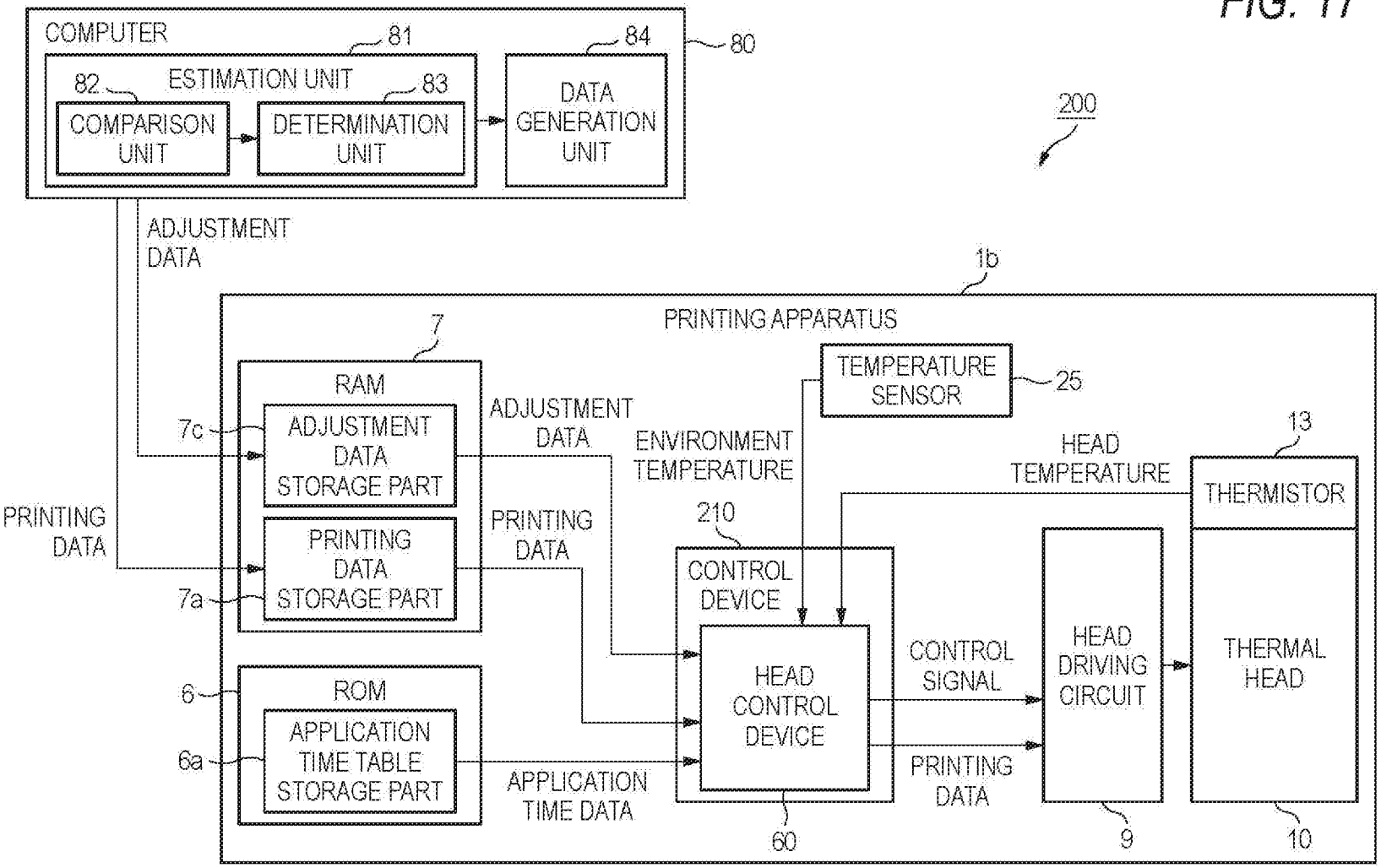
FIG. 17 exemplifies a hardware structure of a printing system 200.

FIG. 17 exemplifies a hardware structure of a printing system 200 in accordance with a third illustrative embodiment.

The printing system 200 includes a computer 80, and a printing apparatus 1*b*.

The computer 80 is provided separately from the printing apparatus 1*b*, and can exchange information with the printing apparatus 1*a*. For example, the computer 80 is a standard computer, and includes a processor, a memory, a storage and the like.

The printing system 200 is different from the printing apparatus 1, in that some processing of the printing apparatus 1 in accordance with the first illustrative embodiment is executed by the computer 80.

The computer 80 has an estimation unit 81 configured to function similarly to the estimation unit 40 of the printing apparatus 1 as the processor executes a program.

The estimation unit 81 has a comparison unit 82 configured to function similarly to the comparison unit 41 of the printing apparatus 1, a determination unit 83 configured to function similarly to the determination unit 42 of the printing apparatus 1, and a data generation unit 84 configured to function similarly to the data generation unit 50 of the printing apparatus 1.

That is, the computer 80 has a structure of estimating the specific line based on the printing data, generating the adjustment data for setting the adjustment target lines, and outputting the adjustment data to the printing apparatus 1*a*.

The adjustment data output from the computer 80 to the printing apparatus 1*b* is stored in an adjustment data storage part 7*c*.

The printing apparatus 1*b* is different from the printing apparatus 1, in that it has a control device 210, instead of the control device 5. The control device 210 has the head control device 60 but does not have the estimation unit 40 and the data generation unit 50.

For this reason, the head control device 60 of the printing apparatus 1*b* is configured to read out the adjustment data, which is output from the computer 80 and is stored in the adjustment data storage part 7*c*, and to generate the strobe signal.

Also in the printing system 200 of the third illustrative embodiment, it is possible to suppress the occurrence of sticking by the simple control, like the printing apparatus 1.

The above illustrative embodiments are specific examples for easily understanding the disclosure, and the disclosure is not limited thereto. The printing apparatus, the printing system, the printing control method, and the program can be diversely modified and changed without departing from the claims.

What is claimed is:

1. A printing apparatus comprising:

a thermal head that is configured to print an image on a plurality of lines in a medium, and a processor, wherein the thermal head includes a plurality of heat-generating elements configured to generate heat when a voltage is applied thereto in an application time, and the thermal head is controlled to sequentially print on each of the plurality of lines in the medium, and the processor is configured to:

determine a specific line among the plurality of lines based on printing data for printing the plurality of lines, the specific line being a line estimated to have sticking; and adjust the application time of an adjustment target line so as to be shorter than a reference application time, the adjustment target line having at least one line among the plurality of lines, the at least one line being a line which is to be printed immediately before the specific line, the reference application time being set based on a temperature of the thermal head, wherein the printing data includes each piece of line data for printing each of the plurality of lines, and wherein the processor is configured to:

compare two pieces of line data corresponding to two lines adjacent to each other, among the plurality of lines; and determine the specific line based on a result of the comparison.

2. The printing apparatus according to claim 1, wherein the adjustment target line is one line adjacent to the specific line.

3. The printing apparatus according to claim 1, wherein the processor is configured to:

compare a number of first printing dots to a number of second printing dots, wherein the first printing dots are specified based on one of the two pieces of line data and are set to be printed on the medium, and the second printing dots are specified based on the other of the two pieces of line data and are set to be printed on the medium, and determine the specific line based on a result of the comparison.

4. The printing apparatus according to claim 1, wherein the processor is configured to:

compare a number of first printing dot groups to a number of second printing dot groups, wherein the first printing dots are specified based on one of the two pieces of line data and set to be printed on the medium, and the first printing dot group is a group in which the first printing dots are continuously aligned by a preset number, and second printing dots are specified based on the other of the two pieces of line data and set to be printed on the medium, and the second printing dot group is a group in which the second printing dots are continuously aligned by a preset number, and determine the specific line based on a result of the comparison.

5. A printing apparatus comprising:

a thermal head that is configured to print an image on a plurality of lines in a medium, and a processor, wherein the thermal head includes a plurality of heat-generating elements configured to generate heat when a voltage is applied thereto in an application time, and the thermal head is controlled to sequentially print on each of the plurality of lines in the medium, and the processor is configured to:

determine a specific line among the plurality of lines based on printing data for printing the plurality of lines, the specific line being a line estimated to have sticking; and adjust the application time of an adjustment target line so as to be shorter than a reference application time, the adjustment target line having at least one line among the plurality of lines, the at least one line being a line which is to be printed immediately before the specific line, the reference application time being set based on a temperature of the thermal head, a head driving circuit that is configured to drive the thermal head, and wherein the processor is configured to:

generate adjustment data for setting two or more lines among the plurality of lines, as the adjustment target lines, wherein the two or more lines includes one line which is adjacent to the specific line and are to be printed earlier than the specific line, and transmit a control signal adjusted based on the adjustment data, to the head driving circuit.

6. The printing apparatus according to claim 5, further comprising:

an environment temperature measuring unit that is configured to measure a temperature around the printing apparatus, as an environment temperature, wherein the processor is configured to:

set the number of the lines, which are to be set as the adjustment target lines, based on the environment temperature.

7. The printing apparatus according to claim 5, wherein the processor is configured to set the number of the lines, which are to be set as the adjustment target lines, based on the printing data.

8. The printing apparatus according to claim 5, wherein the adjustment data includes:

target information which designates the lines among the plurality of lines to set the designated lines as the adjustment target lines, and adjustment information which sets an adjustment amount of the application time at each of the adjustment target lines, and wherein the adjustment amount of the application time at each of the adjustment target lines is set so that a difference between the application time and the reference application time is larger as each line is closer to the specific line.

9. The printing apparatus according to claim 8, wherein the adjustment data includes the adjustment information for each of the adjustment target lines.

10. A printing apparatus comprising:

a thermal head that is configured to print an image being formed by a plurality of lines on a medium, and a processor, wherein the thermal head includes a plurality of heat-generating elements configured to generate heat when a voltage is applied thereto in an application time, and the thermal head is controlled to sequentially print on each of the plurality of lines in the medium, and wherein the processor is configured to adjust the application time of an adjustment target line so as to be shorter than a reference application time, the adjustment target line having at least one line among the plurality of lines, the at least one line being a line which is to be printed immediately before a specific line estimated to have sticking, the reference application time being set based on a temperature of the thermal head, wherein the processor is configured to:

set two or more lines among the plurality of lines, as the adjustment target lines, wherein the two or more lines includes one line which is adjacent to the specific line and are to be printed earlier than the specific line, and adjust the application time at each of the adjustment target lines so that a difference between the application time and the reference application time is larger as each line is closer to the specific line.

11. A printing control method of a printing apparatus, wherein the printing apparatus includes a thermal head which is configured to print an image by printing a plurality of lines on a medium, wherein the thermal head includes a plurality of heat-generating elements configured to generate heat when a voltage is applied thereto in an application time, and the thermal head is controlled to sequentially print on each of the plurality of lines in the medium, and wherein the printing control method comprises:

determining a specific line among the plurality of lines based on printing data for printing the plurality of lines, the specific line being a line estimated to have sticking; and adjusting the application time of an adjustment target line so as to be shorter than a reference application time, the adjustment target line being at least one line among the plurality of lines, the at least one line being a line which is to be printed immediately before the specific line, the reference application time being set based on a temperature of the thermal head, wherein the printing data includes each piece of line data for printing each of the plurality of lines, comparing two pieces of line data corresponding to two lines adjacent to each other, among the plurality of lines; and determining the specific line based on a result of the comparison.

12. A computer-readable recording medium having a printing control program for controlling a printing apparatus recorded therein, wherein the printing apparatus includes a thermal head which is configured to print an image by printing a plurality of lines on a medium, wherein the thermal head includes a plurality of heat-generating elements configured to generate heat when a voltage is applied thereto in an application time, and the thermal head is controlled to sequentially print on each of the plurality of lines in the medium, and wherein the printing control program is configured to allow a computer:

to determine a specific line among the plurality of lines based on printing data for printing the plurality of lines, the specific line being a line estimated to have sticking; and to adjust application time of an adjustment target line so as to be shorter than a reference application time, the adjustment target line being at least one line among the plurality of lines, the at least one line being a line which is to be printed immediately before the specific line, the reference application time being set based on a temperature of the thermal head, wherein the printing data includes each piece of line data for printing each of the plurality of lines, and wherein the printing control program is further configured to allow the computer:

to compare two pieces of line data corresponding to two lines adjacent to each other, among the plurality of lines; and to determine the specific line based on a result of the comparison.

* * * * *